343-756 SR
8/22/78 OR 4,109,253

United States Patent [19]
Chu

[11] 4,109,253
[45] Aug. 22, 1978

[54] METHOD AND APPARATUS FOR SUBSTANTIALLY REDUCING CROSS POLARIZED RADIATION IN OFFSET REFLECTOR ANTENNAS

[75] Inventor: Ta-Shing Chu, Lincroft, N.J.

[73] Assignee: Bell Telephone Laboratories, Incorporated, Murray Hill, N.J.

[21] Appl. No.: 770,392

[22] Filed: Feb. 22, 1977

[51] Int. Cl.[2] ..... H01Q 19/06; H01Q 15/22
[52] U.S. Cl. ..... 343/756; 343/909; 343/775; 343/840
[58] Field of Search ..... 343/781 CA, 781 P, 756, 343/775, 777, 840, 909, 100

[56] References Cited

U.S. PATENT DOCUMENTS 3,148,370 9/1964 Bowman ..... 343/909
3,805,268 4/1974 Britt ..... 343/756

*Primary Examiner*—Alfred E. Smith
*Assistant Examiner*—David K. Moore
*Attorney, Agent, or Firm*—Erwin W. Pfeifle

[57] ABSTRACT

The polarization properties of the field radiated from a polarization grid have been found to be similar to those in the aperture of an offset curved focusing reflector. Therefore, broadband cancellation of the polarization rotation in a large offset reflector is substantially accomplished in the present invention by the opposite prerotation of the incident feed radiation via a polarization grid. For maximum cancellation the polarization grid, having parallel spaced-apart elements, is disposed at an angle to a plane normal to the feed axis of the offset reflector which approximates one-half of the value of the angle between the feed axis and the offset reflector axis.

4 Claims, 4 Drawing Figures

METHOD AND APPARATUS FOR SUBSTANTIALLY REDUCING CROSS POLARIZED RADIATION IN OFFSET REFLECTOR ANTENNAS

BACKGROUND OF THE INVENTION

1. Field of the Invention

The present invention relates to a method and apparatus for substantially reducing cross-polarized radiation in offset reflector antennas and, more particularly, to method and apparatus for substantially reducing cross-polarized radiation in offset reflector antennas by substantially cancelling the polarization rotation produced in a large offset reflector by the opposite prerotation of the incident feed radiation via a polarization grid having parallel spaced-apart reflecting elements and disposed at a predetermined angle to a plane normal to the feed axis.

2. Description of the Prior Art

Cross-polarized radiation from an offset reflector is often regarded as a blemish on an otherwise excellent antenna which offers both low sidelobe level and good impedance matching. Although the cross polarization can be minimized using a large effective F/D ratio, the corresponding requirements of small offset angle and large feed aperture are not always convenient in applications.

Various techniques have been devised to substantially reduce cross-polarized radiation. One technique is to detect the cross-polarized radiation component and convert such component into a suitable control signal to minimize the effect of cross polarization. In this regard see, for instance, U.S. Pat. Nos. 3,044,062 issued to M. Katzin on July 10, 1962 and 3,453,622 issued to L. J. McKesson on July 1, 1969.

U.S. Pat. No. 3,363,252 issued to P. S. Hacker on Jan. 9, 1968 discloses an arrangement which mounts cross-polarization suppressor fins in a longitudinal direction on the external sides of an antenna feedline or feedhorn to cancel cross-polarization vectors and maintain the electric vectors parallel to the sides of the feedlines or feedhorn and perpendicular to the fins.

U.S. Pat. No. 3,914,764 issued to E. A. Ohm on Oct. 21, 1975 discloses that linearly polarized transmitted waves experience polarization rotation and polarization conversion effects especially in the ionosphere. The Ohm arrangement uses microwave components to transform the two varying elliptically polarized waves into replicas of the rotated transmitted waves and then uses a conventional polarization rotator to align the waves in their originally transmitted directions.

BRIEF SUMMARY OF THE INVENTION

The present invention relates to a method and apparatus for substantially reducing cross-polarized radiation in offset reflector antennas and, more particularly, to method and apparatus for substantially reducing cross-polarized radiation in offset reflector antennas by substantially cancelling the polarization rotation introduced by a large offset reflector by the opposite prerotation of the incident feed radiation via a polarization grid having parallel spaced-apart reflecting elements and disposed both between the associated feedhorn and the offset reflector and at an angle to a plane normal to the feed axis of a beam of polarized electromagnetic waves which angle is approximately equal to one-half of the angle between the feed and the offset reflector axes.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

In order to increase the communication capacity of a transmission system by using orthogonal polarizations, it becomes essential to maintain the orthogonality to prevent crosstalk. Although cross polarization can be minimized by using a large effective F/D ratio, the corresponding requirements of a small offset angle and a large feed aperture are not always convenient in applications. Broadly defined, the present invention uses a polarization grid having parallel spaced-apart elements for effecting cancellation between polarization rotations or cross polarization components introduced by the main reflector curvature and polarization rotations or cross polarization components introduced by the grid itself.

Figure 1:
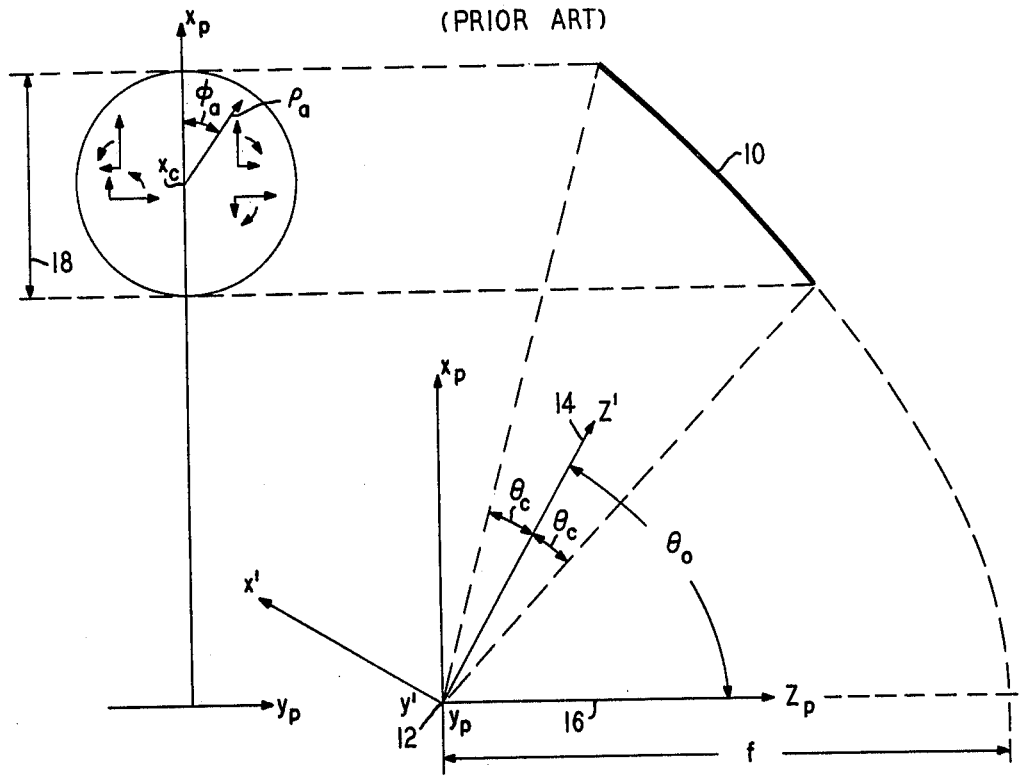
FIG. 1 (PRIOR ART)
FIG. 1 illustrates the typical geometry of a prior art offset paraboloid reflector antenna and the cross-polarized field in the aperture thereof.

For a clearer understanding of the present invention the salient properties of a cross-polarized field in the aperture of an exemplary offset paraboloid reflector will be briefly discussed in association with FIG. 1. For a more complete discussion see "Depolarization Properties of Offset Reflector Antennas" by T. Chu et al in *IEEE Transactions on Antennas and Propagation,* Vol. AP-21, No. 3, May 1973 at pp. 339–345.

In FIG. 1 an offset reflector 10 is illuminated by a feed at the primary focal point 12, where $\theta_o$ indicates the angle between the feed axis Z', designated 14, and the reflector axis $Z_p$, designated 16, and $\theta_c$ indicates the half-angle subtended by the reflector 10 at the focus 12. For a balanced feed radiation, $$\overline{E}_f = F(\theta', \phi') \begin{bmatrix} \cos\phi' & \hat{\theta}' \mp \sin\phi' & \hat{\phi}' \\ \sin\phi' & \cos\phi' & \end{bmatrix} \frac{\exp(-j\rho)}{\rho} \tag{1}$$

the principal polarization component of the reflected field is $$M = \overline{E}_r \cdot \begin{matrix} \hat{x}_p \\ \hat{y}_p \end{matrix} = \frac{F(\theta', \phi')}{t\rho} \Big[ \sin\theta' \sin\theta_o \cos\phi' - \sin^2\phi' \cdot (\cos\theta_o + \cos\theta') - \cos^2\phi'(1 + \cos\theta_o \cos\theta') \Big] \tag{2}$$

while the cross polarization component is $$N = \overline{E}_r \cdot \frac{\hat{y}_p}{\hat{x}_p} = \mp \frac{F(\theta', \phi')}{t\rho} \left[ \sin\theta' \sin\theta_o \sin\phi' - \sin\phi' \cos\phi' (1 - \cos\theta')(1 - \cos\theta_o) \right] \quad (3)$$

where with respect to any point $(x', y', z')$, $\phi' = \tan^{-1}(y'/x')$,
$\theta' = \tan^{-1}(\sqrt{x'^2 + y'^2}/Z')$ and $\rho = \sqrt{x'^2 + y'^2 + Z'^2}$;
$t = 1 + \cos\theta' \cos\theta_o - \sin\theta' \sin\theta_o \cos\phi'$;
$M^2 + N^2 = F^2/\rho^2$; and $N$ vanishes when $\theta_o = 0$. $\theta_o$ is the offset angle between the feed axis 14 and the reflector axis 16. The rotation of the polarization vector due to offset in a paraboloidal aperture 18 has the same magnitude and is in the same sense as illustrated in FIG. 1 for any orientation of the incident linear polarization. The projection of the intersection of a circular cone, with vertex at the focus 12, and the offset paraboloid 10 onto the $x_p y_p$ plane is a circular aperture 18 with the center $$x_c = 2f \sin\theta_o / (\cos\theta_o + \cos\theta_c) \quad (4)$$

and the radius $$a = 2f \sin\theta_c / (\cos\theta_o + \cos\theta_c), \quad (5)$$

where $f$ is the focal length of paraboloid 10.

Figure 2:
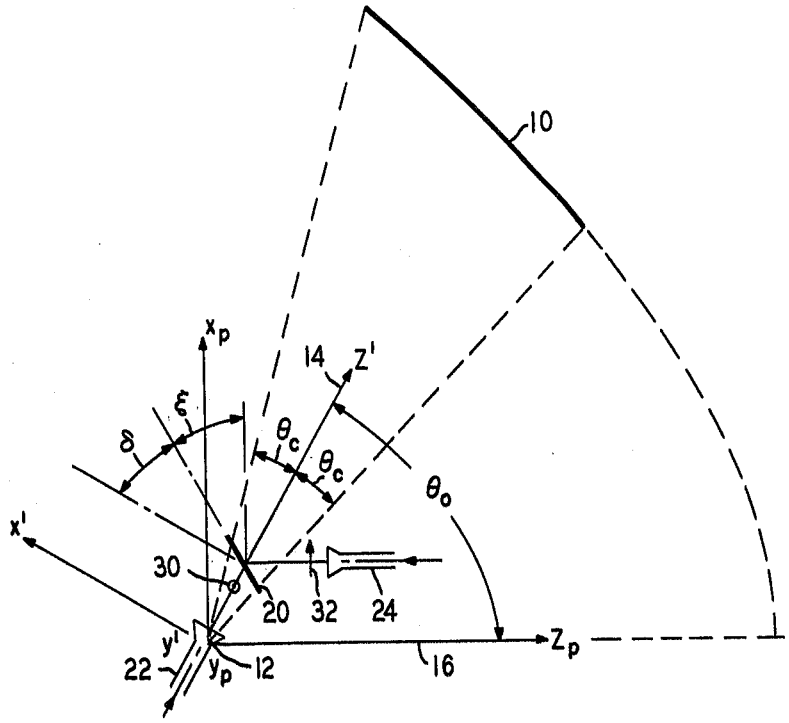
FIG. 2 illustrates the geometry of the offset paraboloid reflector antenna modified in accordance with the present invention to substantially eliminate cross polarization in the aperture of the antenna.

In accordance with the present invention, broadband cancellation of the cross polarization components inherently introduced by a large offset curved focusing reflector is accomplished by introducing cross polarization components which are equal in magnitude but opposite in sign to the cross polarization components introduced by the reflector via a polarization grid oriented in a specific manner. As shown in FIG. 2, a polarization grid 20 is disposed between reflector 10 and the primary focus 12, in the manner to be described hereinafter, to permit electromagnetic waves polarized in a first direction radiating from or coming toward a first feedhorn 22 to pass therethrough while reflecting electromagnetic waves polarized in a second direction orthogonal to the first direction and propagating in either direction between main reflector 10 and a second feedhorn 24. By orienting the polarization grid 20 properly, cross polarization components will be introduced in each of the two orthogonally polarized electromagnetic waves to substantially cancel the cross polarization components introduced by offset reflector 10. The following discussion is given to provide a clear understanding how the present invention functions to substantially cancel polarization rotation introduced by main reflector 10.

The radiation from transmitting and reflecting wire grids can be obtained by magnetic and electric current sheet models, respectively. The principal and cross polarization components can be expressed as $$P = -C[1 - \cos^2\phi'(1 - \cos\theta') - \sin\theta' \cos\phi' \tan\delta] \quad (6)$$

$$X = \pm C[\sin\phi' \cos\phi'(1 - \cos\theta') + \sin\theta' \sin\phi' \tan\delta] \quad (7)$$

where $C$ is a proportionality constant, $\theta'$ and $\phi'$ are the spherical coordinates of the feed (Z') axis, and $\delta$ is the angle between the conducting wires and the $x'y'$ plane as shown in FIG. 2. The expressions inside the brackets can be derived from Equations (9) and (10) specified in the article "Quasi-Optical Polarization Diplexing of Microwaves" by T. Chu et al in *The Bell System Technical Journal*, Vol. 54, pp. 1665–1680, December 1975 by substituting therein the values $\phi' = (\phi - 90)°$ and $\delta = (90 - \gamma)°$. The changes of notation are made primarily for the purpose of comparison with Equations (2) and (3) hereinabove. The upper and lower signs in Equation (7) correspond to the transmitting and reflecting cases. The orientations for the transmitting and reflecting polarizations, designated 30 and 32, respectively, together with the grid geometry are shown in FIG. 2 where the conducting elements of the grid are parallel to the plane of the Figure.

In equations (3) and (7) it can be seen that the leading terms have the same $(\sin\theta' \sin\phi')$ functional dependence on $\theta'$ and $\phi'$. Furthermore, the sign combination indicates that the transmitting and reflecting orthogonal polarizations rotate in the same direction which is opposite to that of the polarization rotation in the aperture of the offset paraboloid reflector 10.

Taking the first order approximation i.e., $\cos\theta' \approx 1$, the cross polarizations in Equations (3) and (7) will approximately cancel each other if $$\delta = \theta_o/2. \quad (8)$$

Since the cancellation of polarization rotation only eliminates the leading terms, the residual cross polarization is to be determined. Assuming that offset reflector 10 is located in the far zone of the radiation from a wire grid 20 as shown in FIG. 2, the principal and cross polarization components in the reflector aperture 18 can be written in the following forms:

$$P = F(\theta')[1 - \cos^2\phi_p(1 - \cos\theta_p) + \sin\theta_p \cos\phi_p \tan\epsilon] \quad (9)$$

$$X = \mp F(\theta')[\sin\phi_p \cos\phi_p(1 - \cos\theta_p) - \sin\theta_p \sin\phi_p \tan\epsilon] \quad (10)$$

where $F(\theta')$ is the feed radiation pattern. The derivation of the above equations is simply a decomposition of the grid radiation into the two orthogonal components of a balanced feed, whose axis coincides with the paraboloidal axis 16. The expressions inside the brackets of Equations (9) and (10) are of the same form as those of Equations (6) and (7); but $\theta_p$ and $\phi_p$ are the spherical coordinates with respect to the paraboloidal $(z_p)$ axis 16 instead of the feed axis 14, and $\epsilon = (\theta_o - \delta)$ denotes the angle between the conducting elements of the grid 20 and the $x_p y_p$ plane as shown in FIG. 2.

The following expressions related Equations (9) and (10) to the normalized aperture 18 coordinates $r = (\rho_a/a)$ and $\phi_a$, where $a$ is the radius of the aperture:

$$\theta' = \cos^{-1}[\cos\theta_p \cos\theta_o + \sin\theta_p \sin\theta_o \cos\phi_p] \quad (11)$$

$$\theta_p = 2\tan^{-1}\left[\frac{\sqrt{(r\sin\theta_c \sin\phi_a)^2 + (\sin\theta_o + r\sin\theta_c \cos\phi_a)^2}}{\cos\theta_c + \cos\theta_o}\right] \quad (12)$$

$$\phi_p = \tan^{-1}\left[\frac{r \sin\theta_c \sin\phi_a}{\sin\theta_o + r\sin\theta_c \cos\phi_a}\right] \quad (13)$$

Figure 3:
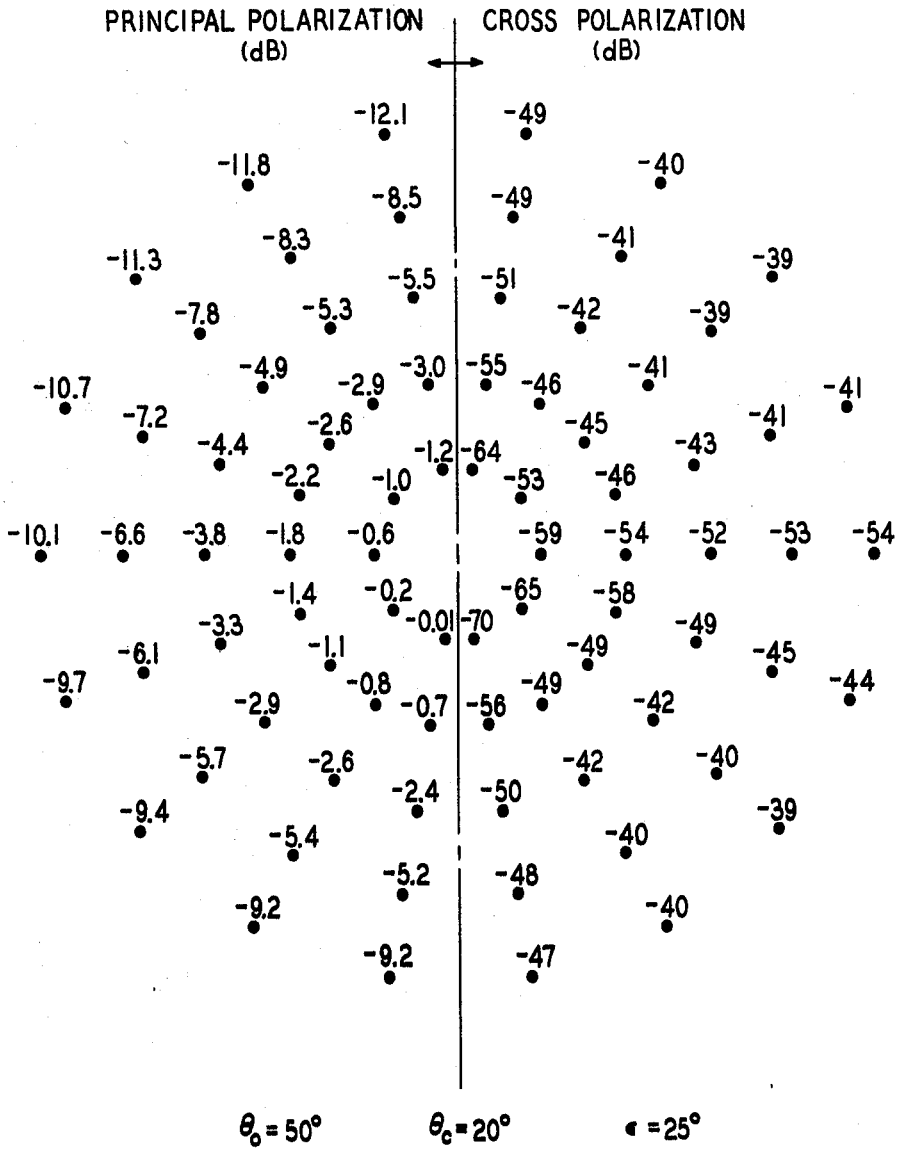
FIG. 3 illustrates the relative amplitude levels in an offset paraboloid aperture for a specific set of parameters in the arrangement of FIG. 2.

Numerical examples of several combinations of parameters ($\theta_o$, $\theta_c$ and $\epsilon$) have been determined for the principal and residual cross polarization components using Equations (9) and (10). The feed pattern has a Gaussian shape with 10 dB taper at the edge of reflector 10 and principal polarization is close to unity (0 dB)

around the center of the reflector aperture 18. The maximum determined residual cross polarization is given in Table I below for a number of examples. FIG. 3 shows a detailed plot of both principal and cross polarizations for the exemplary case where $\theta_o = 50°$, $\theta_c = 20°$, and $\epsilon = 25°$. Only one-half of the aperture 18 is shown for each polarization because of symmetry in the aperture. The maximum residual cross polarization for this example is −38.6 dB, reduced from −24 dB for the same reflector aperture 18 illuminated by a balanced feed without polarizer grid 20. Keeping the same set of $\theta_o = 50°$ and $\theta_c = 20°$, the residual cross polarization becomes −36.4 dB for $\epsilon = 23°$ and −36.1 dB for $\epsilon = 27°$. These results indicate that the residual cross polarization is not overly sensitive to a slight departure from the optimum orientation of $\epsilon = \theta_o/2$.

TABLe I

| Cross Polarization In The Aperture Of An Offset Reflector | | | | |
|---|---|---|---|---|
| $\theta_o$ (DEG) | $\theta_c$ (DEG) | $\epsilon$ (DEG) | Maximum Residual Cross Polarization With Grid (dB) | Maximum Cross Polarization Balanced Feed Without Grid (dB) |
| 50 | 20 | 25 | −38.6 | −24 |
| 50 | 20 | 23 | −36.4 | −24 |
| 50 | 20 | 27 | −36.1 | −24 |
| 60 | 20 | 30 | −38.0 | −22.5 |
| 60 | 30 | 30 | −30.9 | −18 |
| 90 | 20 | 45 | −34.3 | −17.5 |
| 90 | 14 | 45 | −40.5 | −20 |

The examples for $\theta_o = 60°$ and $\epsilon = 30°$ show the residual cross polarizations of −38.0 dB and −30.9 dB for $\theta_c = 20°$ and 30°, respectively. The second order terms are not quite negligible at $\theta_c = 30°$, however the cancellation of cross polarization although partial is still significant. In view of the residual second order $(1 - \cos \theta')$ terms in Equations (6) and (7), the half cone angle, $\theta_c$, of the reflector 10 subtended at focus 12 preferably should not exceed a magnitude of about 20° in order to take full advantage of the cross polarization.

When $\theta_o - \theta_c$ is less than about 30° and $\epsilon = \delta = \theta_o/2$, the feedhorn 24 radiating the reflecting polarization will tend to block the radiation from grid 20. The blocking problem can be eased by using a smaller value of $\epsilon$. This practical difficulty may prevent the optimum orientation of grid elements for reflectors of small offset angle, and hence reduce the effectiveness of the cancellation. The practical application of the present invention is most advantageous in reflectors with large offset angles. The relationship $\epsilon = \theta_o/2$ implies that the grid elements are approximately parallel to the tangent plane at the center of offset reflector 10. It is to be noted that there exists a similarity between this case and a symmetrical small-cone-angle paraboloid illuminated by a grid-covered-feed.

Figure 4:
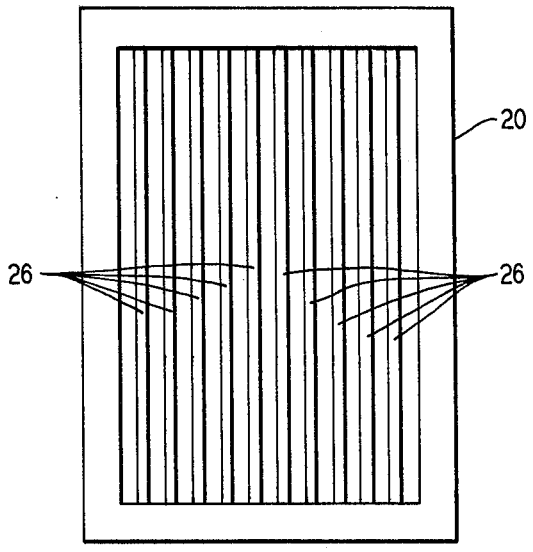
FIG. 4 illustrates a typical polarization grid for use in the arrangement of FIG. 2 for producing cross polarization components which substantially cancel cross polarization components produced by the curved offset main reflector.

From the discussion hereinbefore, cross polarization components introduced by an offset curved reflector antenna can be substantially eliminated by using a feed which transmits through or reflects from a wire grid 20. The grid 20 comprises a plurality of parallel spaced-apart elements 26 as shown in FIG. 4 with the elements thereof oriented at an oblique angle to the feed axis 14 as shown in FIG. 2 rather than perpendicular thereto. Although cross polarization is substantially improved by the use of the presently oriented polarization grid 20 over that found in offset reflector antenna systems not using the grid (Table I), maximum cancellation is achieved when grid 20 is oriented at an angle to a plane normal to the feed axis of the beam of polarized electromagnetic waves which is approximately equal to one-half the angle between the feed and the offset reflector axes. The cross polarization component introduced by polarization grid 20 is approximately equal in magnitude and opposite in sign to the cross polarization component introduced by curved reflector 10 to provide a vast improvement in the cross polarization found in the aperture 18 of main reflector 10.

The present invention has been described hereinbefore primarily in terms of (a) feedhorns 22 and 24 and the associated polarizing grid 20 being disposed on the feed axis 14 of a beam of polarized electromagnetic waves where feed axis 14 corresponds to the feed axis of main reflector 10, and (b) polarizing grid 20 being disposed at the angle $\delta = \epsilon = \theta_o/2$ to a plane normal to the feed axis 14. It will be understood that such description is exemplary only and is for purposes of exposition and not for purposes of limitation. It will be readily appreciated that (a) feedhorns 22 and 24 and polarizing grid 20 can be on a feed axis 14 which does not correspond to the feed axis of main reflector 10 although it is expected that the cross polarization improvement will decrease the further one moves off the feed axis of the reflector, and (b) that the angle $\delta$ can be slightly off from the value of $\theta_o/2$ and still provide improved cross polarization as can be seen from Table I.

It is to be understood that the above-described embodiments are simply illustrative of the principles of the invention and fall within the spirit and scope thereof.

What is claimed is:

1. A method of compensating for cross polarization components introduced in a beam of polarized electromagnetic waves when the beam is reflected from the curved surface of a focusing offset main reflector, the method comprising the steps of:

(a) passing electromagnetic waves of the beam which are both polarized in a first direction and propagating in either direction between the main reflector and a first focal point of said beam through a polarizing grid comprising a plurality of parallel spaced-apart elements which are disposed at an angle to a plane normal to the feed axis of the beam which approximates one-half of the magnitude of the angle between the feed axis of the beam and the axis of the offset main reflector for introducing cross polarization components into said electromagnetic waves polarized in the first direction which are equal in magnitude and opposite in sign to cross polarization components introduced by the main reflector; and (b) reflecting electromagnetic waves of the beam which are polarized in a second direction orthogonal to said first direction and propagating in either direction between the main reflector and a second focal point from the polarizing grid for concurrently introducing cross polarization components into said electromagnetic waves polarized in the second direction which are approximately equal in magnitude and opposite in sign to the cross polarization components introduced by the main reflector.

2. A cross polarization suppressed offset antenna arrangement comprising:

a curved focusing offset main reflector which inherently introduces cross polarization components in a beam of polarized electromagnetic radiation when reflecting said beam in either direction between the aperture and a first focal point thereof; and a polarization grid comprising a plurality of parallel spaced-apart elements disposed both between the offset main reflector and the first focal point along the feed axis of said beam of electromagnetic radiation and at an angle to a plane normal to the feed axis of said beam which approximates one-half of the magnitude of the angle between said feed axis and the axis of the offset main reflector, the elements of the polarizing grid being arranged to pass therethrough the electromagnetic radiation polarized in a first direction and to reflect electromagnetic radiation polarized in a second direction orthogonal to said first direction and propagating in said beam between the main reflector and a second focal point while concurrently introducing cross polarization components which are both approximately equal and of opposite sign to the cross polarization components introduced by said main reflector to effect overall cross polarization cancellation.

3. A cross polarization suppressed offset antenna arrangement according to claim 2 wherein the arrangement further comprises a first and a second feedhorn positioned at the first and second focal point, respectively, and capable of either one of launching and receiving the associated polarized electromagnetic waves.

4. A cross polarization suppressed offset antenna arrangement according to claim 2 wherein the half-angle subtended by the main offset reflector at the focus along the feed axis of said main reflector does not exceed a magnitude of approximately 30°.

* * * * *